US006079588A

United States Patent [19]

Khafizov

[11] Patent Number: 6,079,588

[45] Date of Patent: Jun. 27, 2000

[54] RESEALABLE CONTAINER COVER

[76] Inventor: Michael Khafizov, 105-55 62nd Dr., Apt. 7E, Forest Hills, N.Y. 11375

[21] Appl. No.: 09/427,529

[22] Filed: Oct. 26, 1999

[51] Int. Cl.[7] ..... A47G 19/22

[52] U.S. Cl. ..... 220/711; 220/703; 220/717; 220/675; 222/571; 222/572

[58] Field of Search ..... 220/254, 703, 220/711, 712, 717, 669, 671, 675; 222/562, 566, 571, 572

[56] References Cited

U.S. PATENT DOCUMENTS

| | | | |
|---|---|---|---|
| 612,750 | 10/1898 | McDougall | 222/572 |
| 975,542 | 11/1910 | Letherbury | 222/572 |
| 3,858,767 | 1/1975 | Borin . | |
| 3,977,559 | 8/1976 | Lombardi . | |
| 4,090,660 | 5/1978 | Schram et al. . | |
| 4,202,459 | 5/1980 | DeParales et al. . | |
| 4,210,272 | 7/1980 | Sequin . | |
| 4,738,373 | 4/1988 | DeParales . | |
| 4,796,774 | 1/1989 | Nabinger . | |
| 4,953,743 | 9/1990 | Dart et al. . | |
| 5,088,614 | 2/1992 | Dumestre | 220/713 |
| 5,645,191 | 7/1997 | Neville | 220/717 |
| 5,699,927 | 12/1997 | Lane et al. | 220/254 |
| 5,845,807 | 12/1998 | De Villers | 220/703 |

*Primary Examiner*—Stephen K Cronin
*Attorney, Agent, or Firm*—McAulay Nissen Goldberg & Kiel, LLP

[57] ABSTRACT

A resealable container cover for use in providing, for example, a drink of coffee. It is adapted to be used with a container that has a spout. The cover has a generally circular main portion and a spout portion that extends over the spout of the container. The spout cover portion is hinged to the rest of the top to permit moving between a closed state and an open state. The hinge between the spout portion of the cover and the main portion of the cover avoids the fracturing of a portion of the cover to thereby hold liquid in the container or cup more reliably.

4 Claims, 2 Drawing Sheets

RESEALABLE CONTAINER COVER

BACKGROUND OF THE INVENTION

This invention relates to a cover for a drinking cup and more particularly to one that provides effective sealing and enhanced resealing.

The cover of this invention has a tab on the cover which can be opened to allow drinking from the cup and which can be reclosed to keep the contents from spilling.

Disposal plastic or paper cups are employed for beverages such as coffee and tea with a lid that fastens on the top to prevent spillage. Such lids normally have a tab which can be bent up and back to provide an opening from which the user can drink liquid. The tab recloses to limit spillage. Examples of sealing covers are shown in U.S. Pat. No. 3,858,767; U.S. Pat. No. 3,977,559; U.S. Pat. No. 4,090,660; U.S. Pat. No. 4,202,459; U.S. Pat. No. 4,210,272; U.S. Pat. No. 4,738,373 and U.S. Pat. No. 4,796,774.

The primary operational limitation of the designs shown in the above patents, and other designs observed in use by applicant, is that the resealing feature has limited effectiveness. After the tab is first lifted, often by breaking a scored line that joins the tab to the rest of the cover, the subsequent closure of the tab often fails to provide adequate sealing. Inadequate sealing is of particular concern where the liquid is hot. It is also of particular concern where the drinker involved is driving an automobile and drinks from the cup a number of times thereby needing to reseal the container or cup after each mouthful or sip of coffee or other beverage.

Accordingly, the primary purpose of this invention is to provide a cover which will more effectively and more consistently reseal the beverage in a cup after the user has open the tab and drunk a portion of the beverage.

It is a related purpose of this invention to achieve the above purpose with a design that is relatively inexpensive to produce so that it is likely to be considered cost effective in competition with other known covers.

It is a further related purpose of this invention to achieve the above purposes with a design that is easy to use and manipulate so that a drinker who, for example, is driving a car can open and reseal the container easily as well as safely.

It is a further related purpose of this invention to provide such a device as is readily adapted to be used as a disposable container cover.

BRIEF DESCRIPTION

In brief, an embodiment of this invention is a resealable container cover that has a generally circular main portion for covering a generally circular container and also has a spout portion that extends radially outward from the main portion of the top. This cover is adapted to be used with a container that has a spout. The spout cover portion is hinged to the rest of the top so that the spout cover can be moved from a closed state which is generally coplanar with the rest of the top to an open state in which the spout cover portion is rotated about the hinge and extends angularly upward away from the top.

A sealing groove extends around the periphery of the cover including the generally circular top portion and the spout portion. The sealing groove snaps over a mating rim on the top of the container with which it is designed to be used. Thus there is a sealing engagement between the cover and both the main portion of the container and the spout portion of the container.

Most importantly, the hinge is between the spout cover portion of the cover and the main portion of the cover. Thus no line on the top of the cover has to be broken or ruptured when the spout cover portion is first moved from its closed state to its open state. When the spout cover portion is reclosed, there is no break or compromise on the surface of the cover. The liquid in the cup is more effectively and reliably retained than if a break had to be made on the surface of the cover when opening the spout.

DESCRIPTION OF THE PREFERRED EMBODIMENTS

Figure 1:
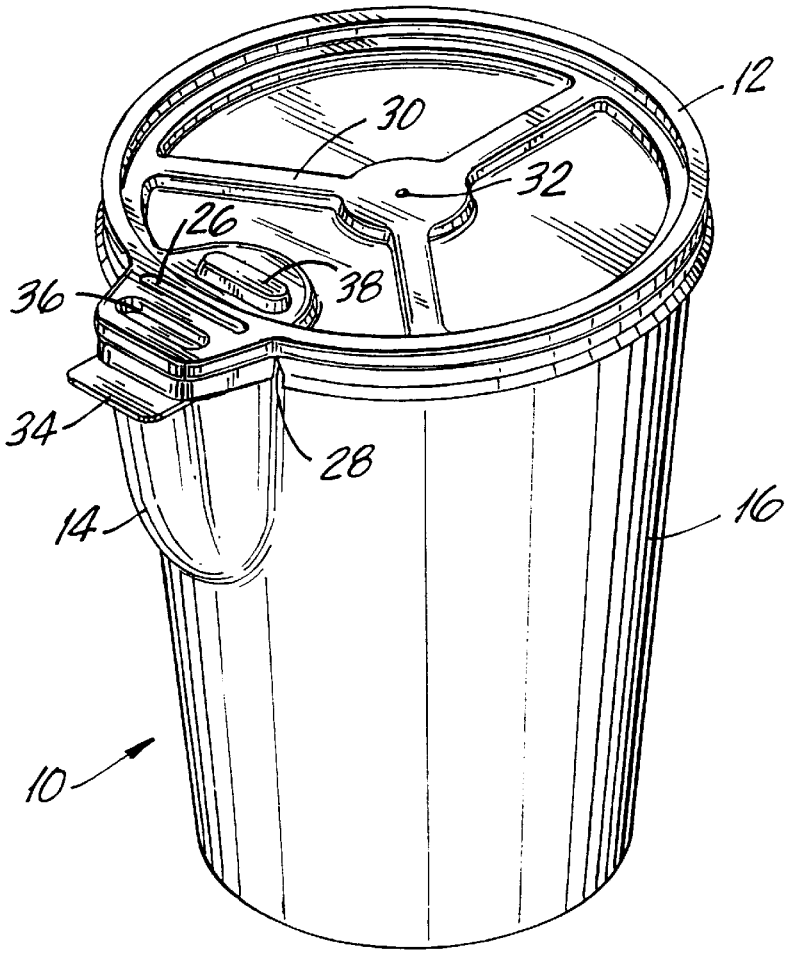
FIG. 1 is a perspective view of the embodiment of this invention showing the container cover on an appropriate matching container.
Figure 2:
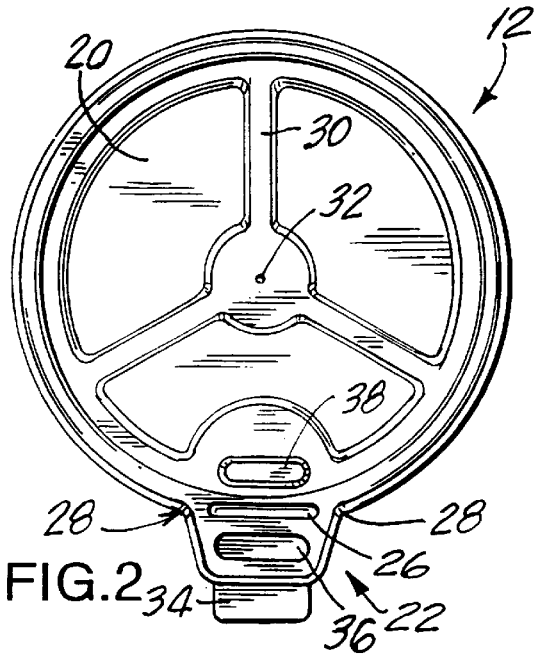
FIG. 2 is a plan view of the FIG. 1 container cover.
Figure 3:
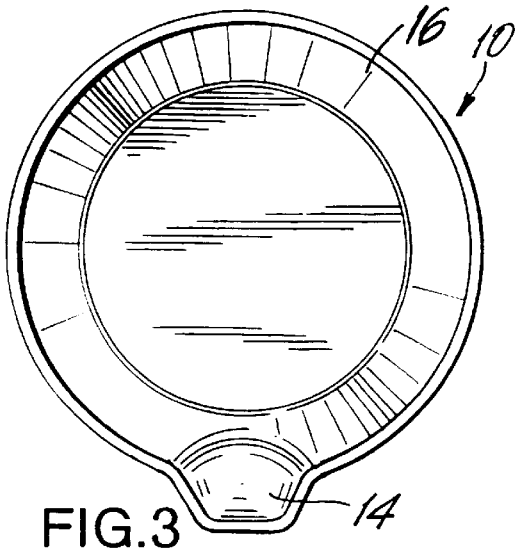
FIG. 3 is a plan view of the FIG. 1 container with which the FIG. 2 container cover is adopted to be used.
Figure 4:
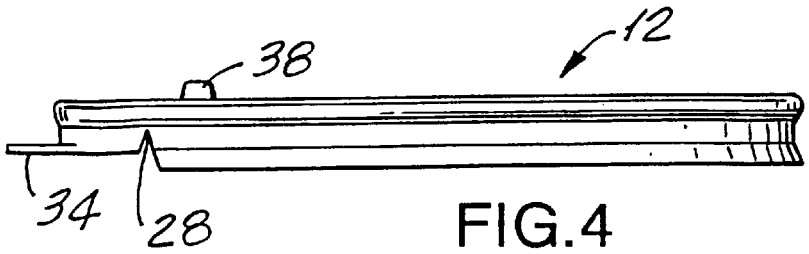
FIG. 4 is a side view of the FIG. 2 container cover.

FIGS. 1 through 6 represent a single embodiment. There is a cup 10 and a cover 12. The upper portion of the cup has a spout 14 which is configured to permit someone to drink out of the cup. The spout 14 extends radially outward from the main body 16 of the cup. The upper rim of the cup has a circumferential rib 18 which extends around both the main body 16 and spout 14 portions of the cup. This rib 18 aids in engaging and mating a groove on the cover.

The cover 12 has a generally circular top cover portion 20 which serves to cover the generally circular top of the container. The cover 12 also has a spout covering portion 22 which in the closed state shown in FIG. 1 covers the spout 14. When in the closed state, the top cover 20 and the spout cover 22 are generally coplanar.

The periphery of the cover 12 has a groove 24 which extends around the periphery and engages the rib 18 when the cover 12 is placed on the container 10. Since the products are made of known types of plastic that are generally used for these types of containers and covers, it is known how to design an engagement between groove 24 and rib 18 which will effectively seal the contents of the container from spillage in normal use. The groove 24 extends around the entire periphery of both the top cover 20 and spout cover 22.

The material of the cover 12 is preferably compressed along a line that forms a hinge 26 between the top cover portion 20 and spout cover portion 22. This hinge 26 is a straight line that permits the user to rotate the spout cover 22 between the closed state shown in FIG. 1 and the fully open state shown in FIG. 5. Thus when the spout cover 22 is moved between an open and closed state, there is no break along the upper surface of the cover 12. Thus when the spout cover is resealed, there is no compromise of the unbroken surface that covers and seals the main body 16 and spout 14 of the container 10.

It is true that at the junctures 28, the groove 24 will be broken. This break in the groove 24 at the juncture 28 can either be initially built in or can occur when the user first rotates the spout cover 22 from its closed state to its open state. But that break at the juncture 28 does not compromise the unbroken upper surface. Thus it has a nil effect on the effectiveness of the cover 12 to prevent spillage even after many openings and closings of the spout cover 22.

As is known in this art, it is preferable to employ on the cover reinforcing ribs 30 and a small vent opening 32. A small hand tab 34 facilitates the user opening and closing the spout cover 22.

Figure 5:
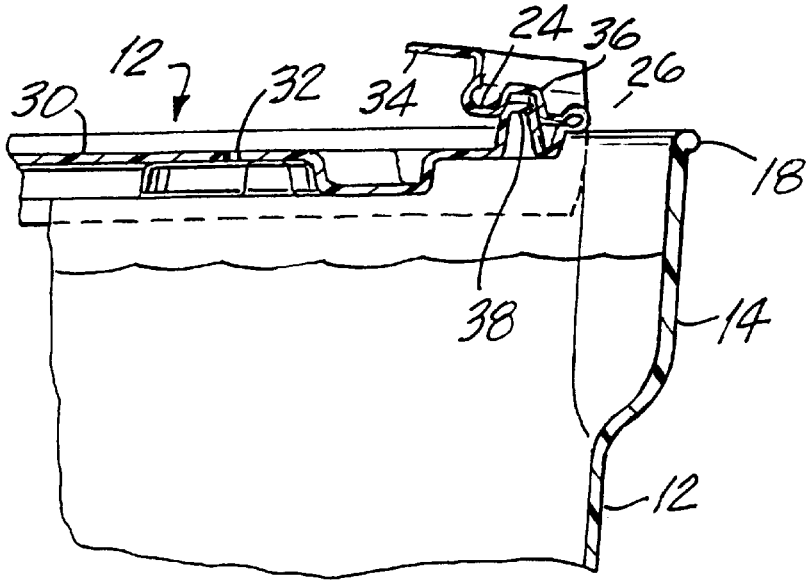
FIG. 5 is a cross-sectional view of the upper quadrant of the FIG. 1 view showing the spout cover in the open state.
Figure 6:
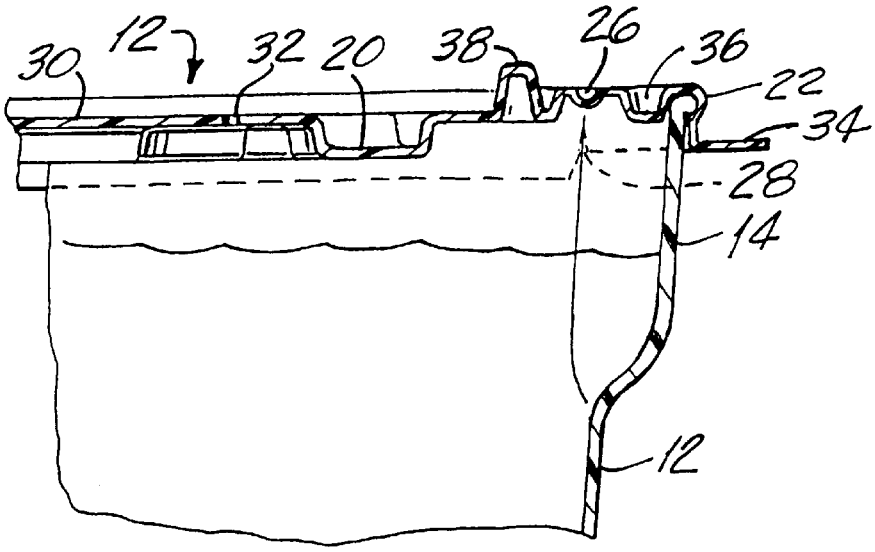
FIG. 6 is a cross-sectional view similar to FIG. 5 showing the spout cover in the closed state.

In one preferred design, a mating ridge 38 on the top cover portion 20 and groove 36 on the spout cover 22 facilitates, as shown in FIG. 5, the holding of the spout cover 22 in its open state in use.

What is claimed is:

1. A resealable container cover for engagement with a mating container comprising:

a generally circular top cover, a spout cover extending outwardly from said top cover, and a hinge between said top cover and said spout cover, said spout cover having a closed state wherein said spout cover is generally coplanar with said top and an open state wherein said spout cover is rotated about said hinge and extends angularly upward from said top, said top cover and said spout cover having a periphery, a sealing groove extending around said periphery of said top cover and said spout cover to provide substantially circumferential sealing with the upper ridge of a mating container having a spout, said sealing groove having a first portion around said top cover and a second portion around said spout cover, said first and second portions having first and second junctures at the respective end points of said hinge, said spout cover when in said closed state providing an unbroken covering surface across said hinge between said container covering top cover and said spout cover.

2. The resealable container cover of claim 1 wherein:

said junctures between said first and second portions of said sealing groove being initially connected, said first and second portions of said sealing groove separating at said junctures when said spout cover is first opened from its closed state to its open state, said separation at said junctures being the sole separation between portions of said container cover when the state of said container cover is changed.

3. The resealable container cover of claim 1 further comprising:

an inter-engaging recess and projection, one of said recess and projection being positioned on said top cover and the other of said recess and projection being positioned on said spout cover, said recess and projection engaging one another when said spout cover is rotated about said hinge to a fully open state, said spout cover being held by the engagement between said recess and said projection in said fully open state.

4. The resealable container cover of claim 1 further comprising:

a manual tab extending outwardly from said spout cover to facilitate manually opening said spout cover.

* * * * *